US006857548B1

(12) United States Patent
Clark

(10) Patent No.: US 6,857,548 B1
(45) Date of Patent: Feb. 22, 2005

(54) POWER ACTUATED TOOLS

(75) Inventor: Philip Charles Clark, Benalla (AU)

(73) Assignee: Cetram Pty Ltd., Victoria (AU)

( * ) Notice: Subject to any disclaimer, the term of this patent is extended or adjusted under 35 U.S.C. 154(b) by 0 days.

(21) Appl. No.: 09/856,043

(22) PCT Filed: Sep. 18, 2000

(86) PCT No.: PCT/AU00/01136

§ 371 (c)(1),
(2), (4) Date: May 17, 2001

(87) PCT Pub. No.: WO01/21359

PCT Pub. Date: Mar. 29, 2001

(30) Foreign Application Priority Data

Sep. 17, 1999 (AU) ..... PQ2924

(51) Int. Cl.[7] ..... B25C 1/04
(52) U.S. Cl. ..... 227/130; 227/10; 173/211
(58) Field of Search ..... 227/9, 10, 130; 173/211

(56) References Cited

U.S. PATENT DOCUMENTS

RE30,617 E 5/1981 Butler et al.
4,941,391 A * 7/1990 Ehmig et al. ..... 227/10
5,538,172 A * 7/1996 Jochum et al. ..... 173/212
5,715,983 A 2/1998 Lee
5,884,828 A * 3/1999 Hirtl et al. ..... 227/10
6,123,243 A * 9/2000 Pfister et al. ..... 173/211
6,126,055 A * 10/2000 Gantner et al. ..... 227/10

FOREIGN PATENT DOCUMENTS

WO 00/35638 6/2000

* cited by examiner

*Primary Examiner*—Eugene Kim
*Assistant Examiner*—Christopher Harmon
(74) *Attorney, Agent, or Firm*—Lowe Hauptman & Berner, LLP

(57) ABSTRACT

An explosively operated tool (1) for driving a fastener into a substrate such as steel or concrete has a resetting mechanism (12) for resetting a piston (10) of the tool into a rear part of a barrel assembly (8) of the tool after each firing of the tool. The barrel assembly (8) is mounted for axial movement within the tool housing (2) and co-operates with a mass mounted for rearwards movement relative to the housing (2) in opposition to a biasing force to absorb recoil on firing of the tool. The resetting mechanism (12) for resetting the piston (10) into a rear part (2*a*) of the barrel assembly after firing is powered in response to displacement of the mass on recall.

16 Claims, 5 Drawing Sheets

POWER ACTUATED TOOLS

FIELD OF THE INVENTION

The present invention relates to power actuated tools and more particularly to explosively actuated tools for driving a fastener such as a pin into a substrate such as concrete or steel.

BACKGROUND OF THE INVENTION

Explosively actuated tools for driving a fastener such as a pin into a substrate such as concrete or steel conventionally comprise a driving piston which is driven forwardly along the barrel of the tool upon detonation of an explosive charge to drive into the substrate a fastener within the forward end of the barrel. After the firing stroke has been to completed, the driving piston is within the forward end of the barrel and appropriate action must be taken to reset the piston into a rear position within the barrel in preparation for the next driving stroke. This may be achieved by a manual action by the operator. One method of manually resetting the piston and which is widely used in practice involves the operator drawing the barrel forwardly from the housing of the tool while the piston is restrained so that the piston lies within a rear part of the barrel which is then retracted manually back into the housing.

There have been proposals for automatic or semi-automatic resetting of the piston. One such proposal involves the use of the explosive gas generated on firing the tool to drive the piston back into its rear position within the barrel after firing. Such a system can however lead to safety problems as the ducting of the explosive gas to a piston return mechanism can result in accumulation of unburnt explosive powder within the mechanism. Further, the problem arising from unburnt residues may be compounded if the tool is not used shortly after resetting of the piston and is subject to rough handling or vibration, for example by being transported on the floor of a truck, whereby the previously reset piston can move out of its predetermined rear position thereby leading to loss of power and possible generation of increasing amounts of unburnt residue at the next firing action.

Alternative proposals for an automatic piston return mechanism involve the use of spring energy which is stored during the driving stroke of the piston and is then released at the end of that stroke to return the piston to its rear position within the barrel. This system however suffers from the disadvantage that part of the driving force of the piston is used to provide the energy for return or resetting of the piston whereby the effective power of the tool is reduced.

In a conventional explosively actuated tool of the type under consideration, firing of the tool generates a recoil effect similar to that experienced upon discharge of a firearm such as a pistol of rifle and this recoil effect can be quite tiring to the operator of the tool.

SUMMARY OF THE INVENTION

The present invention seeks to provide a tool in which the recoil effect is, at least to a significant extent, absorbed within the tool without passing directly to the hands of an operator holding the tool, with the recoil energy being used to power a system for resetting the piston.

According to the present invention, there is provided an explosively operated tool for driving a fastener into a substrate such as steel or concrete, said tool comprising a housing, a barrel assembly mounted within the housing, and a piston within the barrel assembly and actuated upon firing of the tool to drive a fastener in the forward end of the barrel assembly into a substrate, wherein the barrel assembly is mounted for axial movement within the housing and co-operates with a mass mounted for rearwards movement relative to the housing in opposition to a biasing force to absorb recoil on firing of the tool, and a resetting mechanism for resetting the piston into a rear part of the barrel assembly after firing, said resetting mechanism being powered in response to displacement of said mass on recoil.

In a preferred embodiment the resetting mechanism comprises means for engaging the piston in a forward position in the barrel, and means for displacing the engagement means rearwardly to thrust the piston rearwardly, said displacement means comprising an energy source in which energy is stored as a result of displacement of the recoil mass upon recoil.

In a preferred embodiment the energy source comprises a spring in which potential energy is stored in response to displacement of the recoil mass, said potential energy suddenly being released to cause the piston to be propelled rearwardly. The spring may be a coil spring, an elastomeric spring, or a gas spring.

In a particularly preferred embodiment, the recoil mass is propelled rearwardly against a strong resilient bias to absorb the recoil force and is then propelled forwardly by that bias, the spring associated with the resetting mechanism being charged with potential energy in response to the forwards movement of the recoil mass.

Preferably, the engagement means comprises means for gripping the piston at its forward end portion when in its forward position within the barrel assembly. Preferably, the gripping means is interposed between forward and rear barrel sections of the barrel assembly, said forward and rear barrel sections preferably being separate barrel sections.

Preferably, piston retention means are provided to retain the piston in its rearmost position after resetting, said retention means acting in response to rebound of the piston from its rearmost position as a result of the sudden thrust used to effect resetting.

BRIEF DESCRIPTION OF THE DRAWINGS

An embodiment of the invention will now be described, by way of example only, with reference to the accompanying drawings in which.

DETAILED DESCRIPTION OF THE DRAWINGS

Figure 1:
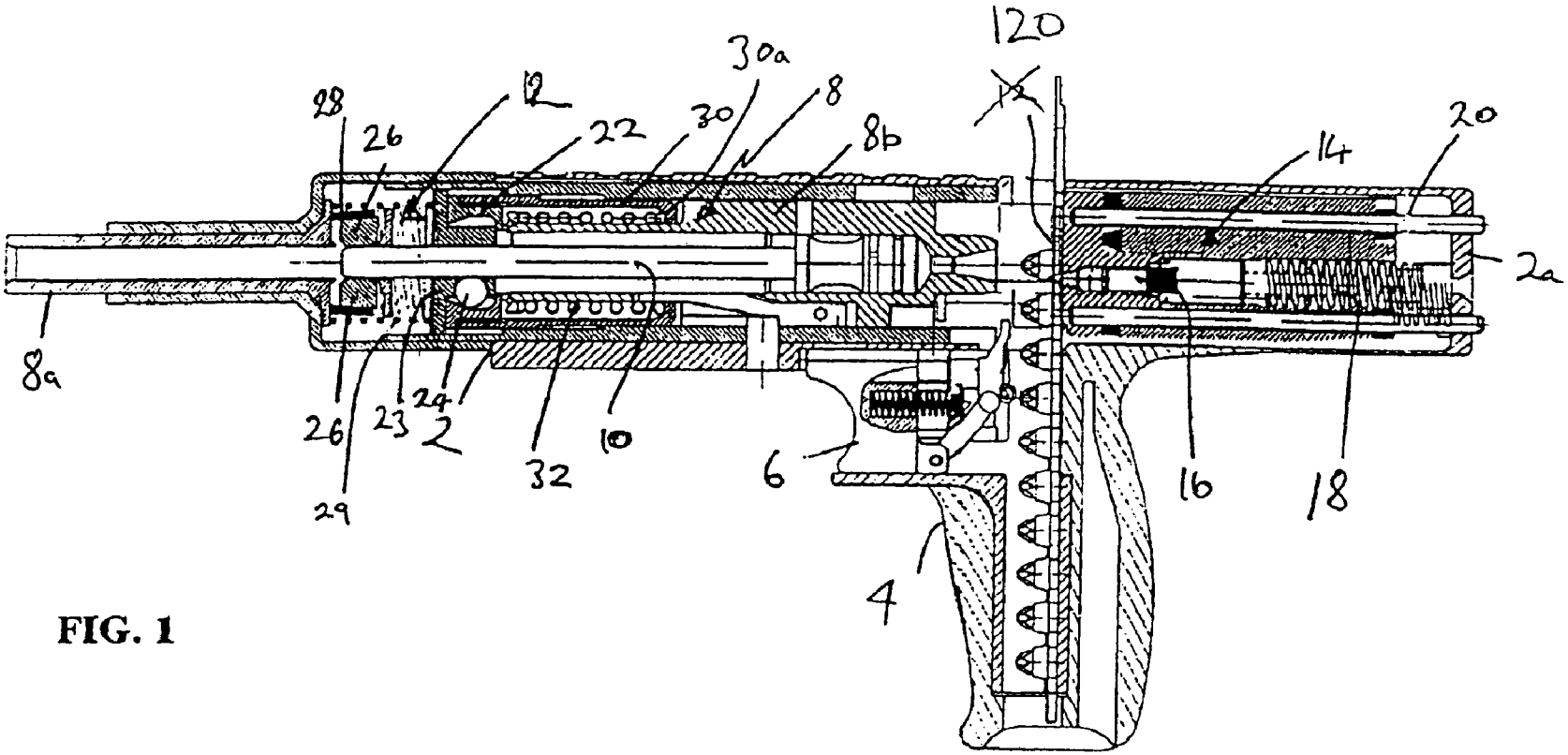
FIG. 1 is a schematic longitudinal section of a tool in accordance with a preferred embodiment of the invention, the tool being shown in an at rest position after completion of a firing stroke in which a fastener has been driven into the substrate and the driving piston of the tool has been reset into a rear position within the barrel assembly, the configuration of FIG. 1 being immediately prior to cocking of the tool.

As shown in the accompanying drawings an explosively actuated tool for driving a fastener such as a pin into a substrate such as concrete or steel, comprises a main multi-part housing 2 having a handle 4 with a trigger 6 which co-operates with a firing mechanism in conventional manner. A barrel 8 mounted within the housing 2 carries a drive piston 10 which is propelled forwardly along the barrel 8 upon firing of an explosive charge so as to drive into the substrate a fastener within the forward end of the barrel 8. The rear end of the barrel 8 co-operates in conventional manner with a strip 120 containing a number of explosive charges arranged seriatim along the strip. The barrel 8 comprises a front section 8*a* which projects forwardly from the housing and a separate rear section 8*b*. The front and rear barrel sections 8*a*, 8*b* are each mounted for axial movement relative to the housing 2 and the two barrel sections 8*a*, 8*b* are separated by a piston retention and resetting mechanism 12 which is also mounted for axial movement within the housing 2. The mechanism 12 has a central passage aligned with the bore of the front and rear barrel sections 8*a*, 8*b* whereby the piston 10 can extend from the rear barrel section 8*b* into the front barrel section 8*a* via the mechanism 12.

Figure 2:
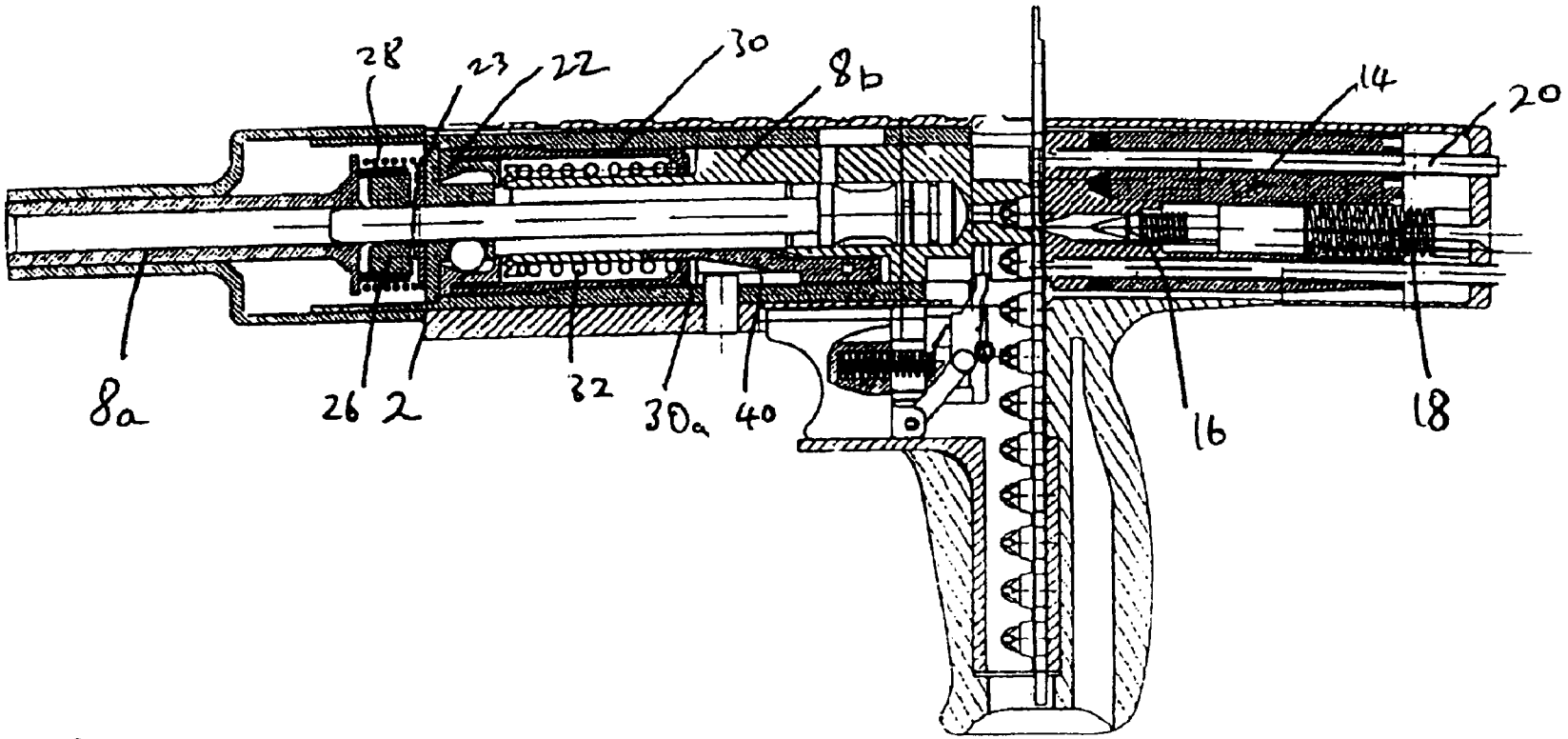
FIG. 2 is a section similar to FIG. 1 but showing the configuration when the tool is cocked by pressing the forward end of the barrel assembly against a substrate preparatory to firing.

The barrel 8 is subjected to a spring bias which causes the forward end of the barrel to project forwardly of the housing 2 as shown in FIG. 1. Cocking of the tool to enable firing requires the forward end of the barrel 8 to be pressed against the substrate so that the barrel is retracted into the housing 2 against the spring bias. This is a safety feature which is conventional in explosively actuated tools of this type to ensure that firing can only take place when the forward end of the barrel is pressed firmly against the substrate. This condition is illustrated in FIG. 2. In its rearmost position as shown in FIG. 2, the rear end of the barrel 8 co-operates with a breach block assembly 14 which includes the firing pin 16 and other components of the firing mechanism. In a conventional explosively actuated tool of this type, the breach block assembly is fixed relative to the housing. In contrast, in the tool of the present invention the breach block assembly 14 is mounted for axial movement in the housing 2 between a forward position as shown in FIGS. 1 and 2, this being the position in which it is able to co-operate with the rear end of the barrel 8 when the barrel is displaced rearwardly upon cocking, and a position rearwardly of that forward position. This rearwards movement occurs in opposition to the bias of one or more strong compression springs 18. The breach block assembly 14 also includes guide rods 20 mounted for longitudinal sliding movement within a rear part of the housing shown schematically at 2*a* in the drawings so as to guide the breach block assembly 14 during its rearward movement. The or each of the strong compression springs 18 is interposed between the rear part 2*a* of the housing and the breach block assembly 14. In the cocked position of the tool (FIG. 2) when the barrel 8 is displaced rearwardly relative to the housing 2 when the forward end of the barrel 8 is pressed against the substrate, the rear limit position of the barrel 8 is provided when the rear end of the barrel 8 meets the forward face of the breach block assembly 14 and the force of the compression spring(s) 18 is such that the breach block assembly 14 is held in its forward position by the spring(s) 18 in opposition to the force applied on cocking.

In the tool of the invention, the breach block assembly 14 thus forms a "floating" mass in the housing 2 and subject to a forward spring bias, in contrast to conventional arrangements in which the breach block assembly forms a fixed mass within the housing. Accordingly, upon firing of the tool, the recoil force which is applied in a rearwards direction to the breach block assembly 14 as a reactive force to that which drives the piston 10 forwardly through the barrel 8, instead of being translated into a sudden rearwards force applied to the tool housing as occurs when the breach block assembly is fixed relative to the tool housing, the recoil force is translated into a rearwards displacement of the breach block assembly 14 relative to the housing against the bias of the compression spring(s) 18. It is estimated that the recoil force is a very high accelerative force (typically 200 to 300 g) generated within fractions of a millisecond and the dissipation of this force by the rearwards displacement of the mass of the breach block assembly 14 against the spring bias rather than the direct translation of the force into the tool housing tends to isolate the housing from the recoil effect. As will be apparent it is of course essential that the mass of the breach block assembly 14 and the opposing force provided by the compression spring(s) 18 is such as to achieve this effect.

It is important to note that when the breach block assembly 14 displaces rearwardly under the effect of the recoil force, the rear barrel section 8*b* also displaces rearwardly with the breach block assembly 14 due to the counter-force in opposition to the force propelling the piston 10 forwardly and this rearwards movement of the rear barrel section 8*b* is used in the resetting of the piston 10 into the rear part of the barrel in preparation for the next firing as will now be described.

The piston retention and resetting mechanism 12 comprises a main body 22 with a conical inner surface centred on the axis of the barrel. A secondary body 23 of the mechanism 12 carries an array of caged balls 24 (only one of which is shown in the drawings), each ball being interposed for radial movement between the surface of the piston passing through the mechanism 12 and the conical surface on the main body 22. The secondary body 23 carrying the balls 24 is capable of slight axial movement relative to the body 22 between a position such as that shown in FIG. 1 in which the secondary body 23 abuts firmly against the main body 22 whereby the balls 24 are within a wider part of the conical surface of the body 22 and do not therefore grip against the piston 10, and a position in which the secondary body 23 is displaced slightly more forwardly relative to the main body 22 whereby the engagement between the balls 24 and the narrower part of the conical surface forces the balls into tight gripping engagement with the piston 10. The bodies 22 and 23, and the balls 24 form primary components of the resetting function of the mechanism 12 which act to reset the piston after firing as will be described.

The mechanism 12 also has a retention function which acts to retain the piston 10 in its reset position. This function is principally assumed by an array of gripping pads 26 which lie within a conical spring 28 which abuts against the rear end of the front barrel section 8*a*. The pads 26 under the effect of radial pressure exerted by the spring 28 exerts a light gripping pressure on the piston. A compression spring 29 is interposed between the rear end of the forward barrel section 8*a* and the front face of the secondary body 23 to apply an axial bias which moves the secondary body 23 into a position in which the balls 24 are in the wider part of the conical surface of the body 22 and hence do not exert a gripping force on the piston.

The main body 22 of the resetting mechanism is extended rearwardly by a tubular extension 30 which terminates in a radially inwards annular abutment 30*a* overlying the forward end of the rear barrel section 8*b*, the abutment 30*a* forming a rear abutment for a compression spring 32 the forward end of which is attached to the forward end of the rear barrel section 8*a*. In the relaxed condition of the tool after completion of a firing stroke and in the cocked condition of the tool, the body 22 of the resetting mechanism abuts against the forward end of the rear barrel section 8*b* as shown in FIGS. 1 and 2 and the compression spring 32 of the resetting mechanism is in a relatively relaxed state.

Figure 3:
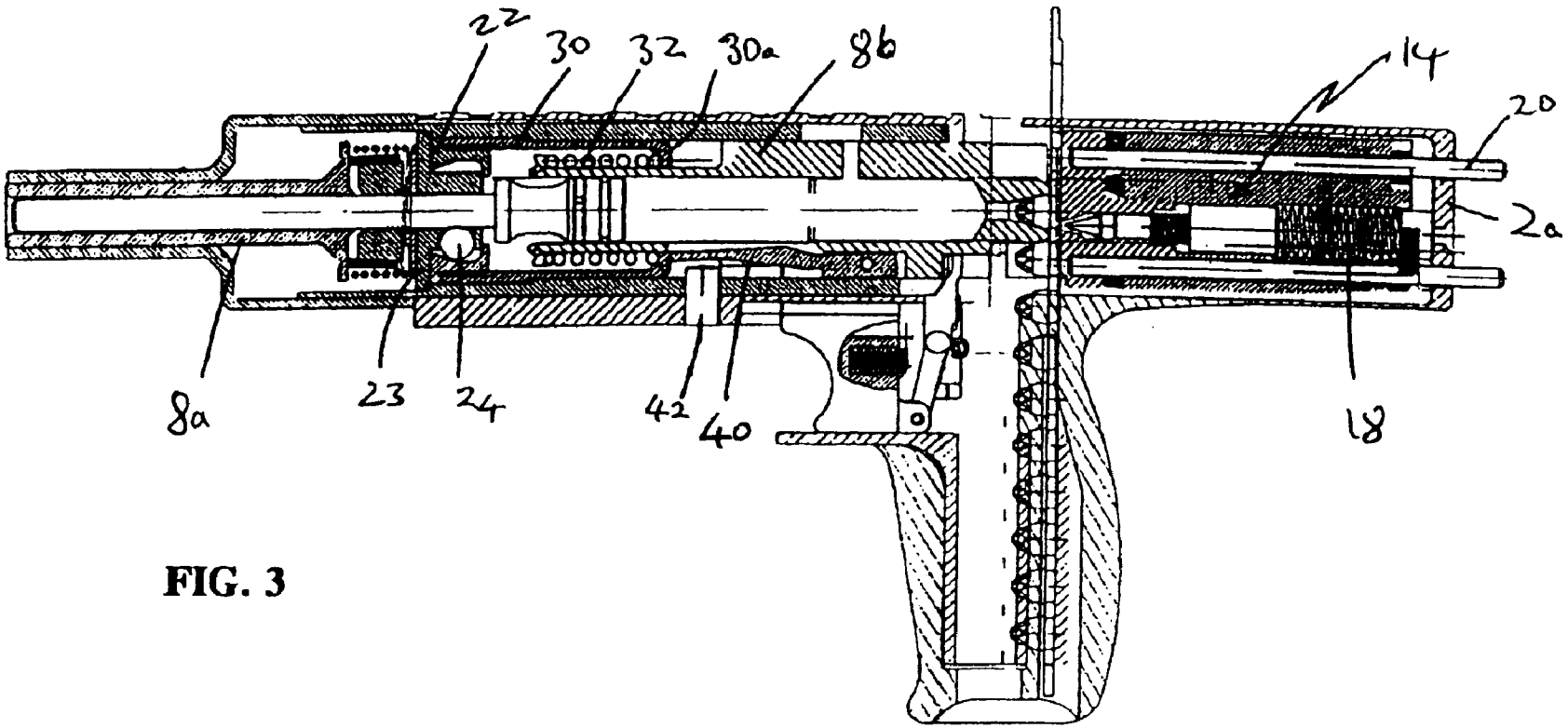
FIG. 3 is a section similar to FIG. 1 but showing the configuration immediately after firing in which the piston is in the forward end of the barrel assembly and a recoil mass is in its rear position relative to the housing of the tool.

In the cocked condition of the tool when the barrel 8 and hence also the resetting mechanism displace rearwardly relative to the housing 2, a rear stop position is defined for the resetting mechanism by interaction between the main body 22 of the resetting mechanism and the interior surface of the housing 2 as shown in FIG. 2. Upon firing of the tool, the rear barrel section 8*b* and breach block assembly 14 displace rearwardly under the effect of the recoil force against the bias of the main compression spring(s) 18 (see FIG. 3). However, rearwards movement of the main body 22 of the resetting mechanism is prevented due to the interaction with the interior surface of the housing 2 as just described and hence the rearwards movement of the rear barrel section 8*b* relative to the body 22 of the resetting mechanism results in compression of the compression spring 32 of the resetting mechanism. As the rear barrel section 8*b* reaches its rearmost position on recoil, a pivotal latch 40 (FIG. 3) carried by the rear barrel section 8*b* is displaced outwardly by a suitable bias such as a spring bias or a bias provided by the exhaust gases of the tool to lie behind the abutment 30*a* and thereby to releasably lock the rear barrel section 8*b* and the body 22 of the resetting mechanism in relative positions in which the forward end of the rear barrel section 8*b* is maintained rearwardly of the main body 22 of the resetting mechanism with the compression spring 32 of the resetting mechanism under its maximum compressive loading.

Figure 4:
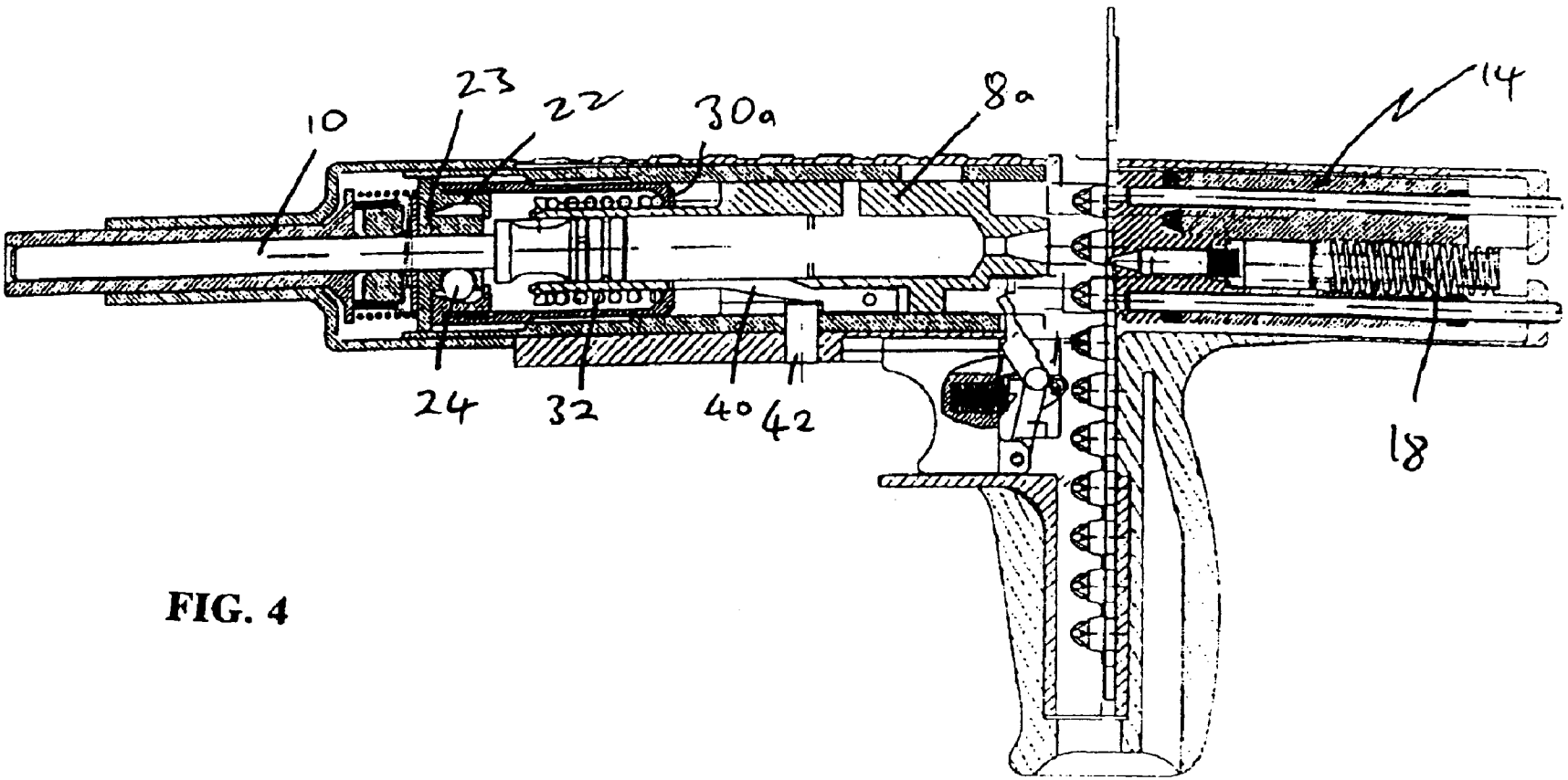
FIG. 4 is a section similar to FIG. 1 but showing the configuration shortly after that of FIG. 3 in which the recoil mass and barrel assembly have returned to a forward position.
Figure 5:
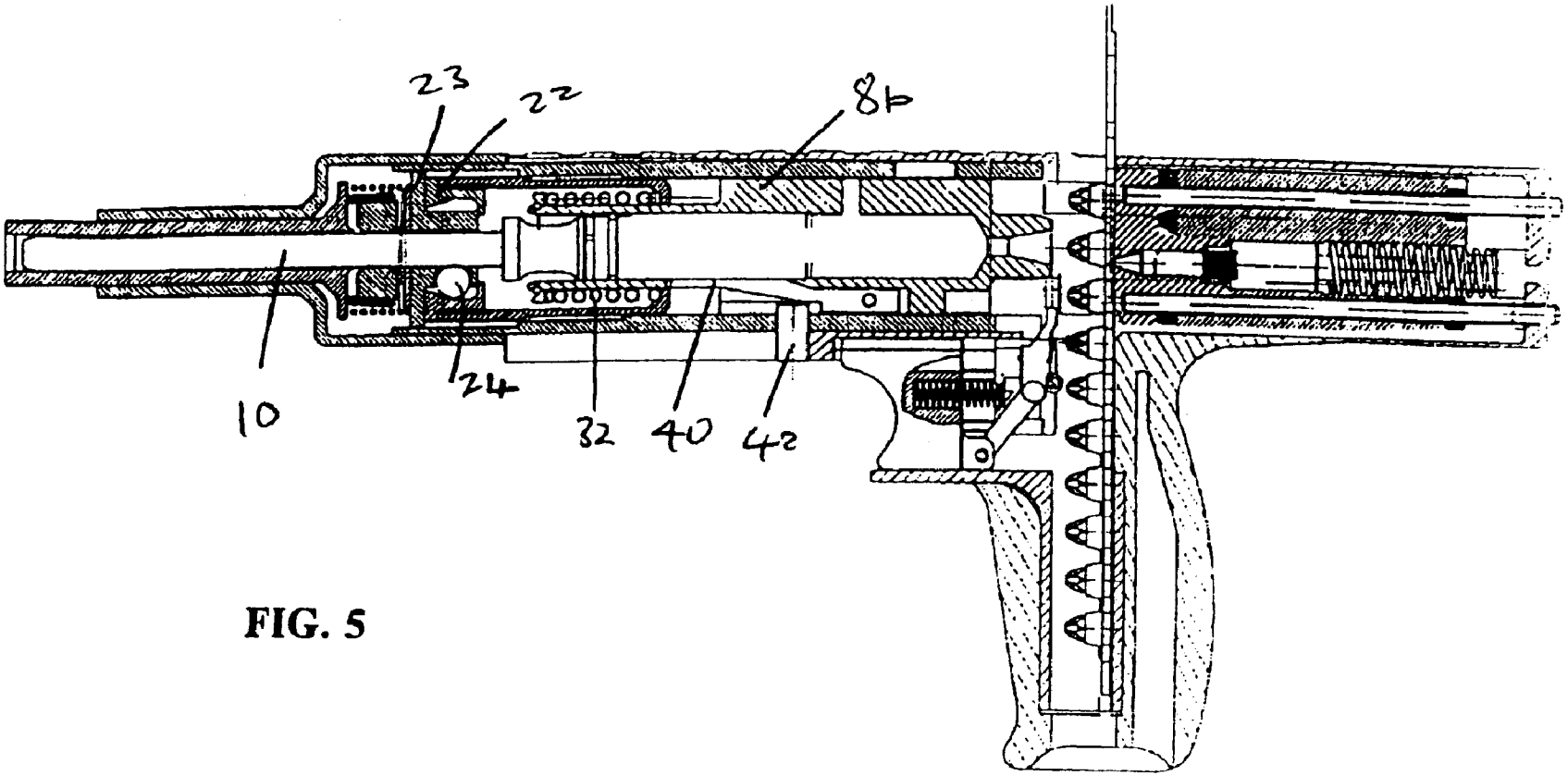
FIG. 5 is a section similar to Figure but showing the configuration shortly after that of FIG. 4 in which resetting of the piston has commenced.

When the recoil force has been absorbed by rearwards movement of the rear barrel section 8*a* and breach block assembly 14 and compression of the main compression spring(s) 18, the main compression spring(s) 18 then unloads by propelling the breach block assembly 14 and rear barrel section 8*b* forwardly. The breach block mechanism 14 reaches a forward stop position but due to the momentum applied to the rear barrel section 8*b* its forward movement through the housing 2 continues until the forward end of the body 22 of the resetting mechanism which is rigidly linked to the rear barrel section 8*b* by the latch 40 reaches the forward end of the housing. As the rear barrel section 8*b* approaches its forward-most position in the housing, an unlocking cam 42 on the housing 2 interacts with the latch 40 on the rear barrel section 8*b* to pivot the latch 40 out of locking engagement with the abutment 30*a* of the resetting mechanism so that the resetting mechanism is released from its locking engagement with the rear barrel section 8*b* at the forward extent of the movement (see FIGS. 4 and 5). Release of the latching engagement enables the compression spring 32 linking the body 22 to the rear barrel section 8*b* to suddenly unload whereby the body 22 is moved rearwardly towards the front end of the rear barrel section 8*b*. This rearwards movement of the body 22 under the sudden unloading of the compression spring 32 causes the body 22 to displace slightly axially rearwardly relative to the secondary body 23 carrying the balls 24 whereby the balls 24 are forced by the narrower part of the conical surface into tight gripping engagement with the piston 10 which is in its forward-most position at that point whereby the piston 10 is also propelled rearwardly with a sudden force. When the body 22 meets the forward end of the rear barrel section 8*b* and can move rearwardly no further, the rearwards momentum previously applied to the piston 10 enables the rearwards movement of the, piston 10 to continue, the movement of the piston 10 displacing the balls 24 into the wider part of the cone within the body 22 to ensure that the balls do not impede this movement. The momentum ensures that the piston 10 is returned into its rearmost position in the rear barrel section 8*a* in preparation for the next firing (see FIG. 1).

It is to be noted that during the resetting of the piston 10 within the barrel 8 in which the piston is propelled rearwardly relative to the barrel it also displaces rearwardly relative to the gripping pads 26. This rearwards displacement of the piston relative to the gripping pads 26 slightly draws the pads 26 axially rearwardly into the wider part of the conical spring 28 whereby to reduce almost to zero the gripping pressure exerted on the piston so that the pads 26 do not interfere with its rearward setting movement. However after the piston 10 has been reset into its rearmost position within the barrel there is a possibility that the piston 10 may slightly "rebound" forwardly from its rear stop position within the rear barrel section 8*b*. This rebound effect is resisted by the gripping pads 26 which, under the forwards movement of the piston 10 upon rebound, will be forced by the piston into the narrower part of the conical spring 28 so that the gripping pads 26 will exert on the piston sufficient radial pressure to resist rebound and to retain the piston 10 in its rear position. It is to be noted that even although the gripping pads 26 may not capture the piston 10 in its fully reset position, at the commencement of cocking of the tool on the next firing stroke, the rearwards displacement of the front barrel section 8*a* will cause the pads 26 and spring 28 to displace rearwardly into abutment with the secondary body 23 (this is the condition shown in FIG. 2) and this displacement will cause the pads 26 to grip the piston to a sufficient extent as to displace the piston fully into its rearmost position within the barrel. This final resetting motion not only overcomes the problem of slight forwards rebound of the piston after primary resetting but also addresses a similar effect which may occur if the tool is not used for a long period of time after the previous firing and is subject to intense vibration, for example on the floor of a truck, whereby the piston "creeps" forwardly from its previously reset position. It is to be noted that although when the piston 10 is driven forwardly during the firing stroke the pads 26 will exert a gripping force on the piston, this force is of restricted extent and will be negligible in comparison with the kinetic energy of the piston on firing and hence will result in negligible power reduction.

In the tool particularly described it will then be appreciated that resetting of the piston after firing occurs automatically under the effect of the recoil forces. This not only results in no diminution of the driving power applied to the piston but, in the embodiment described, also provides effective isolation of the recoil forces from the operator.

Although in the embodiment described the recoil system and resetting mechanism involve the use of compression springs in the form of coil springs other spring arrangements such as tension springs, elastomeric springs, or gas springs can alternatively be used to absorb the recoil forces and to power the resetting mechanism. The resetting mechanism may also utilise means other than gripping balls for applying the resetting force to the piston.

The embodiment has been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The reference to any prior art in this specification is not, and should not be taken as, an acknowledgment or any form of suggestion that that prior art forms part of the common general knowledge in Australia.

What is claimed is:

1. An explosively operated tool, comprising a housing;

a barrel assembly mounted within the housing;

a piston within the barrel assembly and actuated upon firing of the tool to drive a fastener in the forward end of the barrel assembly into a substrate, wherein the barrel assembly is mounted for axial movement within the housing and co-operates with a mass mounted for rearwards movement relative to the housing in opposition to a biasing force to absorb recoil on firing of the tool; and a resetting mechanism for resetting the piston into a rear part of the barrel assembly after firing, said resetting mechanism being powered in response to displacement of said mass on recoil;

wherein the resetting mechanism comprises engagement means for engaging the piston in a forward position in the barrel; and displacement means for automatically displacing the engagement means rearwardly relative to said housing to thrust the piston rearwardly relative to said housing, said displacement means comprising an energy source in which energy is stored as a result of displacement of the recoil mass upon recoil.

2. A tool according to claim 1, wherein the energy source comprises a spring in which potential energy is stored in response to displacement of the recoil mass, said potential energy suddenly being released to cause the engagement means and the piston to be propelled rearwardly relative to said housing.

3. A tool according to claim 2, wherein the recoil mass is propelled rearwardly against a strong resilient bias to absorb the recoil force and is then propelled forwardly by that bias, the spring associated with the resetting mechanism being charged with potential energy in response to the forwards movement of the recoil mass.

4. A tool according to claim 1, wherein the engagement means comprise gripping means for gripping the piston at a forward end portion of said piston when the piston is in the forward position within the barrel assembly.

5. A tool according to claim 4, wherein the gripping means are interposed between front and rear barrel sections of the barrel assembly.

6. A tool according to claim 4, wherein the gripping means comprise balls arranged around the axis of the piston to engage a peripheral surface of the piston, said balls co-operating with an inclined surface to force the balls into gripping engagement with the piston upon rearwards movement of the gripping means relative to the piston.

7. The tool of claim 1, wherein said engagement means are moveable relative to the forward end of said barrel assembly.

8. The tool of claim 7, further comprising a spring other than said energy source, wherein said engagement means are connected to said forward end of said barrel assembly by said spring.

9. The tool of claim 1, further comprising braking means for catching and stopping the piston on rebound after said piston has been reset into the rear part of the barrel assembly by said resetting mechanism, said braking means being different from said engagement means.

10. An explosively operated tool for driving a fastener into a substrate, said tool comprising:

a housing;

a barrel mounted to the housing for axial movement relative to the housing between a first forward position and a first rearward position;

a piston axially displaceable within the barrel between a second forward position and a second rearward position, said piston being explosively driven forwardly from the second rearward position to the second forward position, causing a recoil movement of said barrel from the first forward position to the first rearward position; and a resetting mechanism connecting the barrel and the piston for automatically and physically moving the piston rearwardly relative to said housing from the second forward position to the second rearward position in response to a return movement of the barrel from the first rearward position to the first forward position.

11. A tool according to claim 10, wherein said resetting mechanism comprises:

a catching element releasably engaging the piston; and a spring attached to the barrel and the catching element, respectively;

wherein said spring is configured so that potential energy is stored in said spring in response to the recoil movement of said barrel and is not released until said barrel has passed an intermediate location between the first rearward position and the first forward position on the return movement.

12. A tool according to claim 11, wherein said barrel has a latch that engages the catching element and rigidly connects the barrel with the catching element when said barrel is between the first rearward position and the intermediate location on the return movement, said latch is disengaged from said catching element when said barrel is between the intermediate location and the first forward position.

13. A tool according to claim 11, wherein the catching element is configured to engage and rearwardly drive the piston when the catching element is driven rearwardly when the energy is released by the spring.

14. The tool of claim 11, wherein said barrel comprises a front portion retractably projecting from a front end of said housing and a rear portion completely received and moveable within said housing, said front portion being connected to said catching element which is connected to an end of said spring which has an opposite end connected to said rear portion.

15. The tool of claim 10, further comprising braking elements for catching and stopping the piston on rebound after said piston has been reset into the second rearward position by said resetting mechanism, wherein said braking elements are not part of said resetting mechanism and operate independently of said resetting mechanism.

16. An explosively operated tool for driving a fastener into a substrate, said tool comprising:

a housing;

a barrel mounted to the housing for axial movement relative to the housing between a first forward position and a first rearward position;

a piston axially displaceable within the barrel between a second forward position and a second rearward position, said piston being explosively driven forwardly from the second rearward position to the second forward position, causing a recoil movement of said barrel from the first forward position to the first rearward position; and a resetting mechanism connecting the barrel and the piston for automatically resetting the piston from the second forward position to the second rearward position in response to a return movement of the barrel from the first rearward position to the first forward position;

wherein said resetting mechanism comprises a catching element releasably engaging the piston, and a spring attached to the barrel and the catching element, respectively;

wherein said spring is configured so that potential energy is stored in said spring in response to the recoil movement of said barrel and is not released until said barrel has passed an intermediate location between the first rearward position and the first forward position on the return movement;

wherein said barrel comprises a front portion retractably projecting from a front end of said housing and a rear portion completely received and moveable within said housing, said front portion being connected to said catching element which is connected to an end of said spring which has an opposite end connected to said rear portion; and wherein said tool further comprises another spring disposed between and connecting said front portion and said catching element.

* * * * *